US009141027B1

(12) United States Patent
Furuki et al.

(10) Patent No.: US 9,141,027 B1
(45) Date of Patent: Sep. 22, 2015

(54) CLEANING DEVICE, AND IMAGE FORMING APPARATUS

(71) Applicant: FUJI XEROX CO., LTD., Tokyo (JP)

(72) Inventors: Manabu Furuki, Kanagawa (JP); Masashi Ikeda, Kanagawa (JP); Tatsuhiro Igarashi, Kanagawa (JP); Teppei Yawada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/526,964

(22) Filed: Oct. 29, 2014

(30) Foreign Application Priority Data

Jun. 18, 2014 (JP) ..... 2014-125260

(51) Int. Cl.
*G03G 21/00* (2006.01)
*G03G 15/08* (2006.01)
*G03G 15/01* (2006.01)

(52) U.S. Cl.
CPC ..... *G03G 15/0824* (2013.01); *G03G 15/01* (2013.01); *G03G 21/0041* (2013.01); *G03G 21/0052* (2013.01)

(58) Field of Classification Search
CPC ..... G03G 21/0011; G03G 21/0041; G03G 21/0052; G03G 15/166; G03G 2221/0005; G03G 15/0824; G03G 15/01
USPC ..... 399/71, 343, 350, 99, 101
See application file for complete search history.

(56) References Cited

U.S. PATENT DOCUMENTS 5,970,282 A * 10/1999 Yanagida et al. ..... 399/101
6,125,257 A * 9/2000 Sekine et al. ..... 399/343 X
6,272,295 B1 * 8/2001 Lindblad et al. ..... 399/71 X
8,660,475 B2 * 2/2014 Lawton et al. ..... 399/71 X

FOREIGN PATENT DOCUMENTS

JP 2005-250215 A 9/2005
JP 2006-178433 A 7/2006

* cited by examiner

*Primary Examiner* — Sophia S Chen
(74) *Attorney, Agent, or Firm* — Oliff PLC

(57) ABSTRACT

A cleaning device that cleans a residual toner from a cleaning target includes a cleaning blade that blocks the residual toner containing toner particles and an external additive on the cleaning target and scrapes the residual toner from the cleaning target, a measurement unit that measures an amount of the external additive in the residual toner which is blocked by the cleaning blade and remains on the cleaning target, and a control unit that increases an amount of a toner that is supplied to the cleaning target based on a measurement result obtained by the measurement unit.

11 Claims, 7 Drawing Sheets

CLEANING DEVICE, AND IMAGE FORMING APPARATUS

CROSS-REFERENCE TO RELATED APPLICATIONS

This application is based on and claims priority under 35 USC 119 from Japanese Patent Application No. 2014-125260 filed Jun. 18, 2014.

BACKGROUND

Technical Field

The present invention relates to a cleaning device, and an image forming apparatus.

SUMMARY

According to an aspect of the invention, there is provided a cleaning device that cleans a residual toner from a cleaning target including:

a cleaning blade that blocks the residual toner containing toner particles and an external additive on the cleaning target and scrapes the residual toner from the cleaning target;

a measurement unit that measures an amount of the external additive in the residual toner which is blocked by the cleaning blade and remains on the cleaning target; and a control unit that increases an amount of a toner that is supplied to the cleaning target based on a measurement result obtained by the measurement unit.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described.

Figure 1:
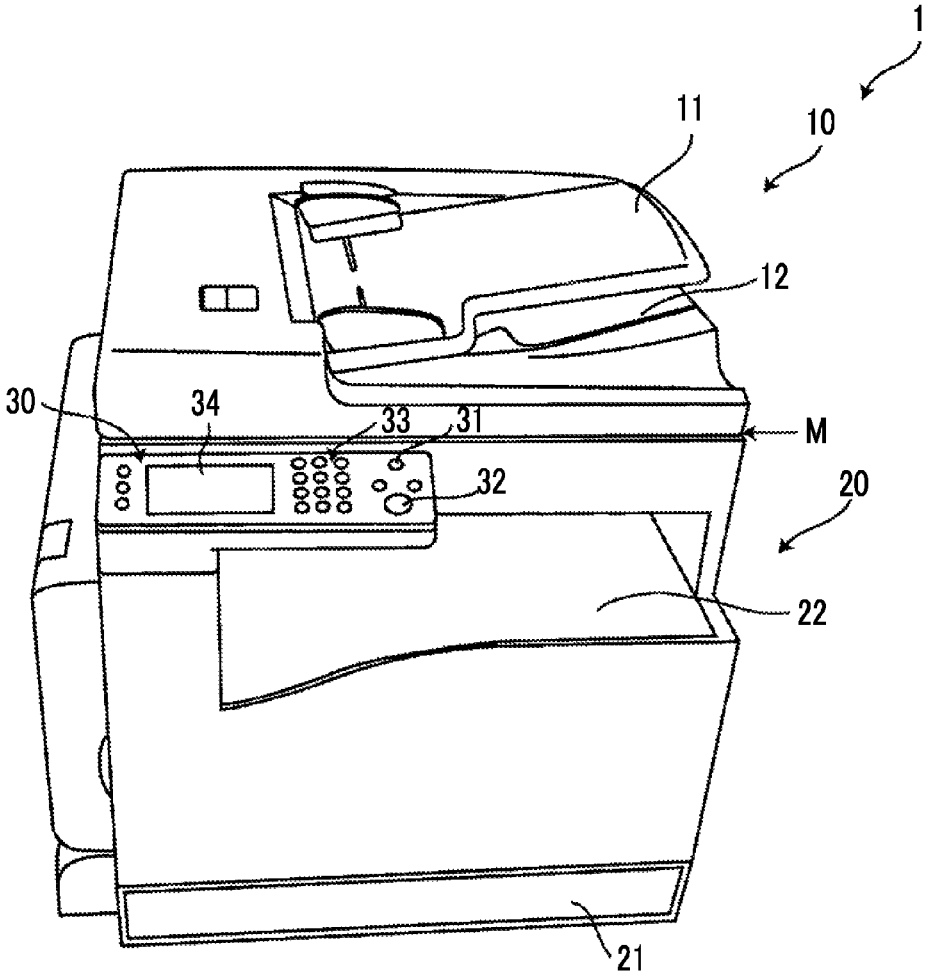
FIG. 1 is an external perspective view of an image forming apparatus as an exemplary embodiment of the invention.

FIG. 1 is an external perspective view of an image forming apparatus as an exemplary embodiment of the invention.

An image forming apparatus 1 includes a scanner 10 and a printer 20.

The scanner 10 is a device that reads an image drawn on an original document and generates an image signal. In addition, the printer 20 is a device that prints out an image based on the image signal on paper.

The scanner 10 includes an original document tray 11 and an original document discharge tray 12. When a start button 32 is pushed in a state in which original documents are placed on the original document tray 11 in a stacked state, the original documents are sequentially transported and read sheet by sheet, and are discharged onto the original document discharge tray 12. In addition, the scanner 10 is provided with a hinge (not shown), which horizontally extends, on an inner side, and thus the scanner 10 may be opened by lifting up a portion on an upper side in relation to an arrow M. A transparent glass plate 13 (refer to FIG. 2) spreads immediately below the arrow M. When a sheet of original document is placed face down on the transparent glass plate 13, the portion on the upper side in relation to the arrow M is closed, and then the start button 32 is pressed, the original document on the transparent glass plate 13 may also be read.

In addition, the printer 20 is a device that sequentially takes out plural sheets of paper, which are stacked inside a paper tray 21, sheet by sheet, and prints an image based on an image signal on the paper that is taken out. The paper on which the image is printed is discharged onto a discharge tray 22. In this exemplary embodiment, the printer 20 is a printer that prints out an image on the paper by a so-called electro-photographic process.

In addition, the image forming apparatus 1 is provided with a user interface (UI) 30. The UI 30 is provided with a power button 31, the start button 32, plural pressing buttons 33 other than the buttons 31 and 32, and a touch panel type display screen 34. Various kinds of instructions such as an instruction of the number of prints and an instruction of operation start are performed by manipulating the UI 30. In addition, an apparatus state or various pressing buttons are displayed on the display screen 34. The pressing buttons 33, which are displayed on the display screen 34, are also manipulation targets.

Figure 2:
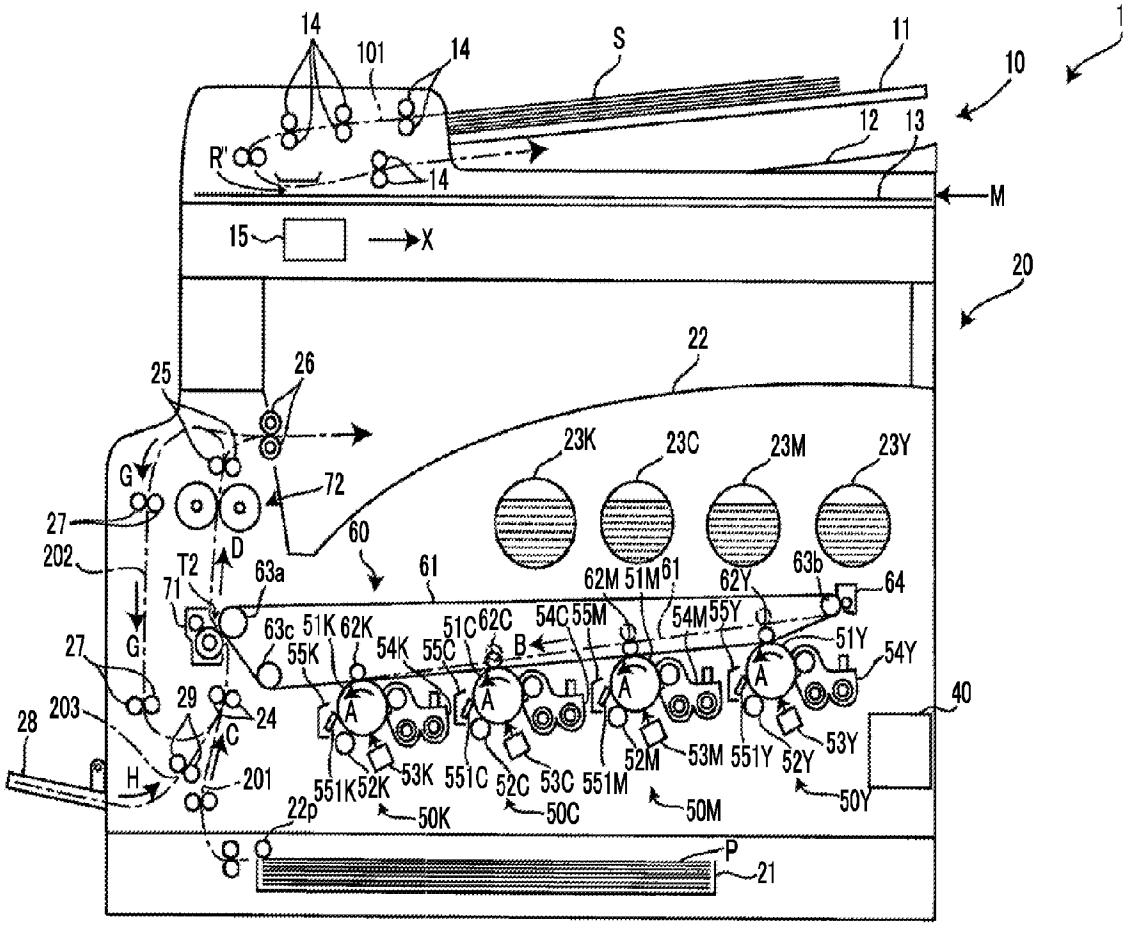
FIG. 2 is a schematic diagram illustrating an internal configuration of an image forming apparatus having an external appearance as shown in FIG. 1.

FIG. 2 is a schematic diagram illustrating an internal configuration of an image forming apparatus having an external appearance as shown in FIG. 1.

When the start button 32 (refer to FIG. 1) is pressed, original documents S, which are placed on the original document tray 11 of the scanner 10, are fed sheet by sheet and are transported on a transport path 101 by feed rollers 14. Each of the original document S passes through a reading position R1 that contacts with the transparent glass plate 13 in the middle of the transportation, and then is discharged onto the original document discharge tray 12. In addition, when the original document S passes through the reading position R1, an image that is recorded on the original document S is read by a reading device 15 that faces the reading position R1 and is stopped, and the read image is converted into an image signal.

In addition, the portion on the upper side in relation to the arrow M is opened, and one sheet of the original document is placed face down on the transparent glass plate 13. Then, the portion on the upper side is closed, and then the start button 32 is pressed. At this time, the reading device 15 reads the original document on the transparent glass plate 13 while moving in a direction of an arrow X, and converts the resultant read image into an image signal.

In addition, the printer 20 includes four image forming units 50Y, 50M, 50C, and 50K which are arranged in a row in an approximately horizontal direction. In the image forming units 50Y, 50M, 50C, and 50K, toner images with color toners of yellow (Y), magenta (M), cyan (C), and black (K) are formed, respectively. Here, in a common description of the image forming units 50Y, 50M, 50C, and 50K, the symbols of Y, M, C, and K for separation of toner colors are omitted, and are described as image forming units 50. This is also true of other constituent elements other than the image forming units.

Each of the image forming units 50 is provided with a photoconductor 51. While the photoconductor 51 receives drive force and rotates in a direction of an arrow A, an electrostatic latent image is formed on a surface of the photoconductor 51, and a toner image is formed by development.

The image forming units 50 is provided with a charging unit 52, an exposure unit 53, a developing unit 54, a primary transfer unit 62, and a photoconductor cleaner 55 at the periphery of the photoconductor 51. Here, the primary transfer unit 62 is placed with an intermediate image transfer belt 61 to be described later interposed between the primary transfer unit 62 and the photoconductor 51. Here, the primary transfer unit 62 is an element that is provided to an intermediate transfer unit 60 to be described later instead of the image forming unit 50.

The charging unit 52 uniformly charges the surface of the photoconductor 51.

The exposure unit 53 irradiates the uniformly charged photoconductor 51 with exposure light that is modulated based on an image signal, and forms an electrostatic latent image on the photoconductor 51.

The developing unit 54 develops the electrostatic latent image, which is formed on the photoconductor 51, with toners of colors according to the respective image forming units 50Y, 50M, 50C, and 50K to form a toner image on the photoconductor 51.

The primary transfer unit 62 transfers the toner image, which is formed on the photoconductor 51, on the intermediate image transfer belt 61 to be described later.

The photoconductor cleaner 55 includes a cleaning blade 551 which is pressed to the photoconductor 51, blocks a residual toner attached to the photoconductor 51 after transfer, and the like, and scrapes the residual toner and the like from the photoconductor 51.

The intermediate transfer unit 60 is disposed on an upper side of the four image forming units 50. In addition, the intermediate transfer unit 60 is provided with the intermediate image transfer belt 61. The intermediate image transfer belt 61 is supported by plural rolls such as a driving roller 63*a*, a driven roll 63*b*, and a tension roll 63*c*. In addition, the intermediate image transfer belt 61 is driven by the driving roller 63*a* and circularly moves on a circulation path including a path along four photoconductors 51, which are provided for the four image forming units 50Y, 50M, 50C, and 50K, in a direction of an arrow B.

Toner images on the respective photoconductors 51 are transferred by an operation of the primary transfer unit 62 to be sequentially superimposed on the intermediate image transfer belt 61. In addition, a toner image transferred onto the intermediate image transfer belt 61 is transported by the intermediate image transfer belt 61 to a secondary transfer position T2. A secondary transfer unit 71 is provided at the secondary transfer position T2, and the toner image on the intermediate image transfer belt 61 is transferred onto the paper P that is transported to the secondary transfer position T2 by an operation of the secondary transfer unit 71. Transport of the paper P will be described later. Toner and the like which remain on the intermediate image transfer belt 61 after transfer of the toner image with respect to the paper P is removed from the intermediate image transfer belt 61 by an intermediate image transfer belt cleaner 64.

Here, the printer 20 has a monochrome mode in which a monochrome image is printed on the paper P with only the image forming unit 50K which forms a toner image with a black (K) toner and which is located at an end (an end on the first left-hand side of FIG. 2) on one side of an arrangement, and a color mode in which a color image is printed on the paper P by using the four image forming units 50Y, 50M, 50C, and 50K. A circulation movement path of the intermediate image transfer belt 61 is changed by a cam mechanism (not shown) in such a manner that the intermediate image transfer belt 61 moves while contacting with the four photoconductors 51, which constitute the four image forming units 50Y, 50M, 50C, and 50K, in the color mode, and the intermediate image transfer belt 61 contacts with only a photoconductive body 51K of the image forming unit 50K, which is located at the end (the end on the first left-hand side of FIG. 2) on one side of the arrangement, and is separated from the photoconductive bodies 51Y, 51M, and 51C of the other image forming units 50Y, 50M, and 50C, in the monochrome mode. In the monochrome mode, the operation of the other image forming units 50Y, 50M, and 50C other than the image forming unit 50K is stopped so as to save electric power or to realize long operational lifespan of the components.

A toner cartridge 23 (23K, 23C, 23M, 23Y) in which a toner of each color is accommodated is provided on an upper side of the intermediate transfer unit 60. When a toner inside the developing unit 54 is consumed during development, a toner is supplied to the developing unit 54 from the toner cartridge 23 (23K, 23C, 23M, 23Y) in which a toner of corresponding color is accommodated. The toner cartridge 23 (23K, 23C, 23M, 23Y) is configured in a detachable manner. When the toner cartridge 23 (23K, 23C, 23M, 23Y) is empty, the toner cartridge 23 (23K, 23C, 23M, 23Y) is taken out, and a new toner cartridge 23 (23K, 23C, 23M, 23Y) is mounted.

In addition, the paper tray 21 is provided at a lower part of the printer 20. The paper P before printing is accommodated in the paper tray 21 in a stacked state. The paper tray 21 is configured in a withdrawable manner for supplementation or replacement of the paper.

A sheet of paper P is taken out from the paper tray 21 by a pick-up roll 22*p*, and is transported on a transport path 201 in a direction of an arrow C to timing adjusting rolls 24 by the feed rollers. The paper P transported up to the timing adjusting rolls 24 is transmitted by the timing adjusting roll 24 toward the secondary transfer position T2 to reach the secondary transfer position T2 at a timing at which the toner image on the intermediate image transfer belt 61 reaches the secondary transfer position T2. The toner image from the intermediate image transfer belt 61 is transferred onto the paper P transmitted by the timing adjusting rolls 24 at the secondary transfer position T2 by an operation of the secondary transfer unit 71. The paper P to which the toner image is transferred is transmitted in a direction of an arrow D and passes through a fixing unit 72. The toner image on the paper P is heated and compressed by the fixing unit 72 and is fixed onto the paper P. According to this, a fixed image composed of the fixed toner image is printed on the paper P. The paper onto which the toner image is fixed by the fixing unit 72 is transported by feed rollers 25, and is transmitted onto the discharge tray 22 from a paper discharge port by paper discharging rolls 26.

In addition, the printer 20 has a double-sided print node in which an image is printed on both surfaces of the paper P. In the double-sided print mode, an image is printed on a first surface of the paper P in the same manner as described above, and then the paper P in which the image is printed on the first surface is transmitted partway to the discharge tray 22 by the paper discharging rolls 26. In addition, the paper discharging rolls 26 inverts the rotation direction and returns the paper P transmitted partway on the discharge tray 22.

The paper P that is returned by the inversion of the paper discharging rolls 26 is transported on a transport path 202 in a direction indicated by an arrow G by feed rollers 27, and reaches the timing adjusting roll 24 again. At this time, the paper P is in a state in which a front side and a rear side are inverted in comparison to the case in which the image is printed on the first surface. After reaching the timing adjusting rolls 24 again, when the same operation as described above is performed, an image is printed on a second surface of the paper P. The paper P in which the images are printed on both surfaces is transmitted onto the discharge tray 22 by the paper discharging rolls 26.

In addition, the printer 20 is provided with a manual feed tray 28. When the start button 32 is pressed in a state in which paper is placed on the manual feed tray 28, the paper on the manual feed tray 28 is transported by feed rollers 29 on a transport path 203 in a direction of an arrow H, and reaches the timing adjusting rolls 24. The subsequent print operations are the same as print operations with respect to the paper P that is taken out from the paper tray 21.

In addition, the image forming apparatus 1 is provided with a control circuit 40 that controls the respective units, and the above-described operations are controlled by the control circuit 40. The control circuit 40 is an example of a control unit in the invention.

Here, in this exemplary embodiment, the amount of an external additive in the toner which is blocked by the cleaning blade 551 and remains on the photoconductor 51 is measured as follows.

Figure 3A:
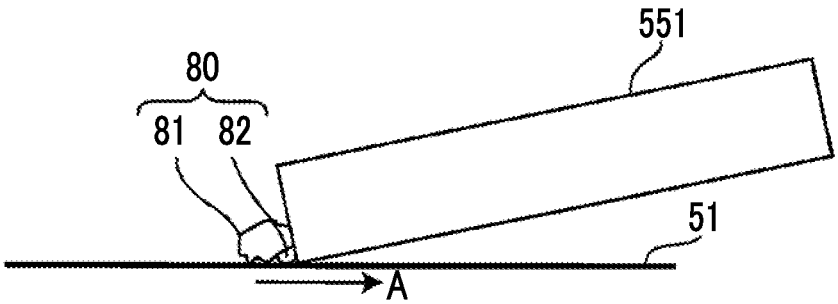
FIGS. 3A to 3C are schematic diagrams illustrating a first example of a method of measuring an amount of an external additive.
Figure 3B:
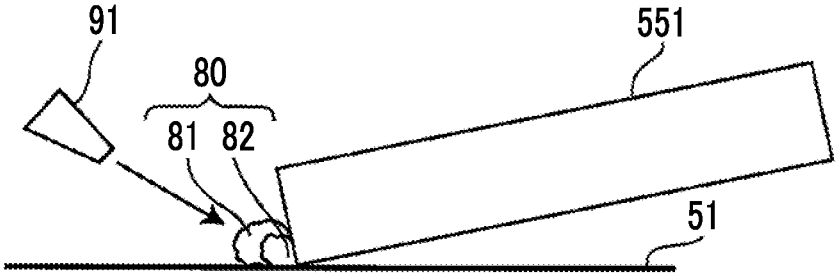
Figure 3C:
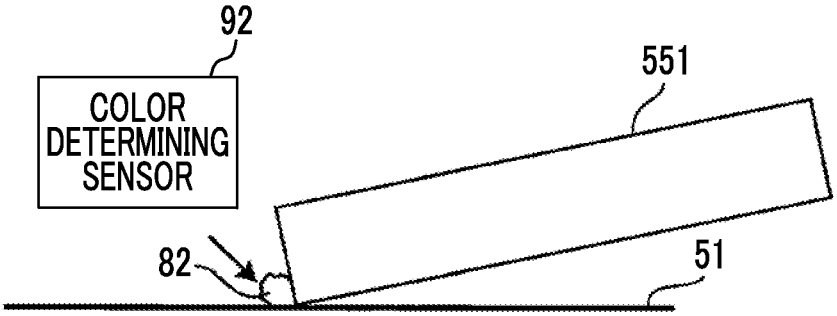

FIGS. 3A to 3C are schematic diagrams illustrating a first example of a method of measuring the amount of the external additive.

However, FIGS. 3A to 3C and drawings to be described later are common to the four image forming units 50 shown in FIG. 2, and thus symbols Y, M, C, and K which indicate colors are omitted after FIGS. 3A to 3C.

As shown in FIG. 3A, the photoconductor 51 rotates in the direction of the arrow A (refer to FIG. 2). In addition, a toner image is formed on an upstream side of the rotation direction (direction of the arrow A) in relation to a portion shown in FIG. 3A, and the toner image is transferred onto the intermediate image transfer belt 61 by the primary transfer unit 62. In addition, toner that remains on the photoconductor 51 after transfer is blocked by the cleaning blade 551, and thus a toner dam 80 is formed. Toner particles and an external additive are included in the toner, and thus the toner dam 80 is also formed from toner particles 81 and an external additive 82. Here, the external additive 82 has an average particle size smaller than that of the toner particles 81. On the other hand, as it goes toward a front side of the rotation direction (direction of the arrow A) of the photoconductor 51, a gap between the photoconductor 51 and the cleaning blade 551 becomes narrow. Accordingly, as schematically illustrated in FIG. 3A, the external additive 82 tends to be collected on the front side of the rotation direction (direction of the arrow A). On the other hand, the toner particles 81 has an average particle size larger than that of the external additive 82, and thus the toner particles 81 are blocked on a rear side of the rotation direction (direction of the arrow A) in comparison to the external additive 82. When the toner particles 81 are blocked by a sufficient amount of the external additive 82, the toner particles 81, which does not stay on the photoconductor 51, is scraped from the photoconductor 51 and is transported by a discharged toner transport member (not shown) that constitutes the photoconductor cleaner 55 (refer to FIG. 2). Then, the transported toner particles 81 are collected in a discharge toner box.

Here, in this exemplary embodiment, a toner having a volume average particle size of 4.5 μm or less is employed. According to this, if the gap between the photoconductor 51 and the cleaning blade 551 is not filled with a sufficient amount of the external additive 82, there is a concern that the toner particles 81 may pass through the gap, and an image defect may occur. In a case of a toner using toner particles having a small particle size, a relatively small amount of toner is sufficient to form an image having the same density. However, since a small amount of toner is sufficient, the amount of the external additive also becomes small. Particularly, if a toner image having a low image density is continuously formed, the amount of the external additive necessary for blocking the toner particles 81 easily becomes insufficient. Therefore, in the first example illustrated in FIGS. 3A to 3C, the amount of the external additive 82, which is accumulated at an arbitrary part of the cleaning blade 551, is measured as follows.

FIG. 3B illustrates an aspect in which air is sprayed to the toner dam 80 by a nozzle 91. In the first example, air is sprayed to the toner dam 80 at every timing determined in advance. The air pressure during the spraying is adjusted to 30 kPa or less. When air that is adjusted to this level of air pressure, for example, 30 kPa is sprayed to the toner dam 80, the toner particles 81 in the toner dam 80 are selectively blown out, and thus the external additive 82 remains. The toner particles 81 that are blown out are carried together with toner particles that are scraped from the photoconductor 51 by the cleaning blade 551, and then is accommodated in the discharged toner box. In addition, toners having a volume average particle size of 2 μm or more are preferably used in consideration of productivity.

The external additive is added to the toner particles for favorable fluidity to improve the cleaning properties of the toner. Examples of the external additive include metal salts such as calcium carbonate, metal oxide compounds such as silica, alumina, titania, barium titanate, strontium titanate, calcium titanate, cerium oxide, zirconium oxide and magnesium oxide, inorganic particles such as ceramics, or resin particles such as vinyl resins, polyesters and silicones, and the external additive may be added to the toner surface in a dry state by application of shearing force, in a similar manner that is employed in conventional toner manufacturing methods.

FIG. 3C illustrates an aspect in which a color of the remaining external additive 82 is measured by a color determining sensor 92 (a measurement unit). In a case of this exemplary embodiment, a surface of the photoconductor 51 takes on a green color, and as shown in FIG. 2, the toner particles 81 have each color yellow (Y), magenta (M), cyan (C), and black (K) in accordance with the image forming unit 50. In contrast, in this exemplary embodiment, the external additive 82 has a white color. Accordingly, it is possible to determine an amount of the external additive 82 that is accumulated at a corresponding portion by measuring a color of the external additive 82 with the color determining sensor 92.

A measurement result by the color determining sensor 92 is input to the control circuit 40 shown in FIG. 2. The control circuit 40 receives an input of the measurement result and determines whether or not the amount of the external additive 82 which is measured by the color determining sensor 92 is equal to or more than a threshold value, or less than the threshold value. In addition, when it is determined as less than the threshold value, the control circuit 40 controls the image forming unit 50 in order for a toner band constituted by a uniform solid image to be formed on the photoconductor 51. When the toner band is formed on the photoconductor 51, the control circuit 40 controls the primary transfer unit 62 in order for the toner band not to be transferred onto the intermediate image transfer belt 61. Accordingly, the toner band formed on the photoconductor 51 reaches the cleaning blade 551 without being transferred onto the intermediate image transfer belt 61, and is used for formation of the toner dam 80.

As described above, a sufficient amount of the external additive 82 is always supplied to the cleaning blade 551, and thus the cleaning blade 551 is prevented from being overloaded. Accordingly, chipping of the cleaning blade 551 is prevented from occurring, and thus a toner is reliably blocked by the cleaning blade 551 and is collected.

Figure 4A:
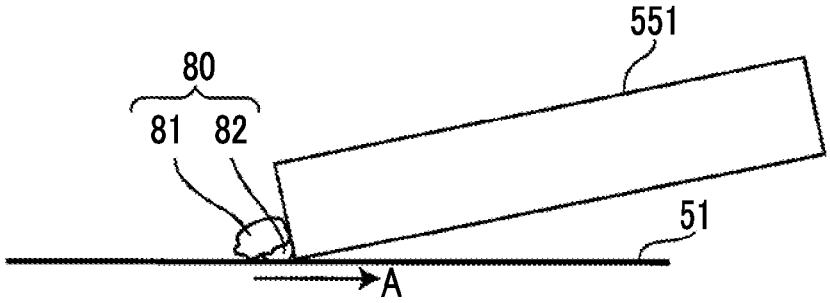
FIGS. 4A to 4C are schematic diagrams illustrating a second example of the method of measuring the amount of the external additive.
Figure 4B:
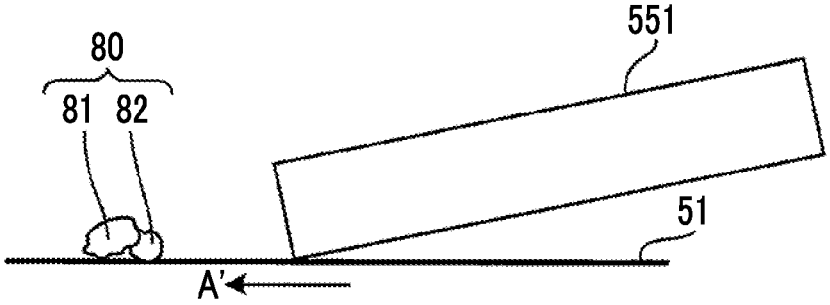
Figure 4C:
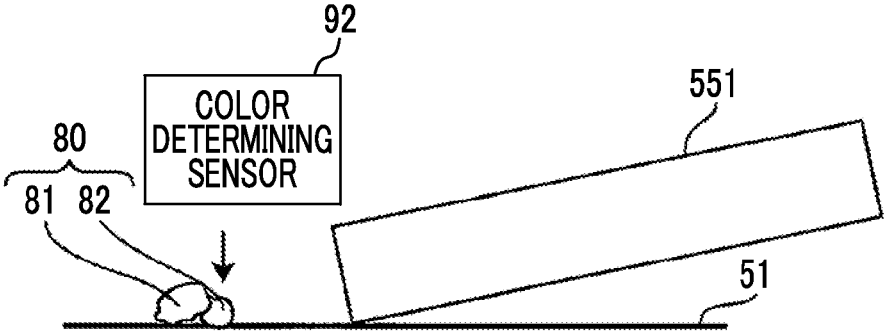

FIGS. 4A to 4C are schematic diagrams illustrating a second example of the method of measuring the amount of the external additive.

In the image forming Apparatus 1 shown in FIGS. 1 and 2, a method that is described with reference to FIGS. 4A to 4C may be employed instead of the measurement method of the external additive 82 described with reference to FIGS. 3A to 3C. This is true of a measurement method to be described later in relation to FIGS. 4A to 4C.

FIG. 4A illustrates an aspect in which the toner dam 80 is formed due to block by the cleaning blade 551. FIG. 4A is the same drawing as FIG. 3A.

Here, at the timing at which the amount of the external additive 82 is measured, as shown in FIG. 4B, the photoconductor 51 reverse rotates once (rotation in a direction of an arrow A'). Accordingly, the toner dam 80 is spaced away from the cleaning blade 551. The color determining sensor 92 measures a color of a front end portion (front end portion in the direction of the arrow A), in which the external additive 82 is rich, of the toner dam 80 spaced away from the cleaning blade 551 as described above. In this case, the toner particles 81 are not removed, and thus the toner particles 81 also partially enter a measurement region of the color determining sensor 92 during measurement of the amount of the external additive 92. However, a threshold value is adjusted in accordance with the colors (Y, M, C, and K) of toners used in the image forming units 50 with respect to the four image forming units 50 (refer to FIG. 2), and it is determined whether or not the external additive 82 is accumulated in a sufficient amount.

In the case of the second example illustrated in FIGS. 4A to 4C, it is possible to measure the external additive without being hindered by the cleaning blade.

Figure 5A:
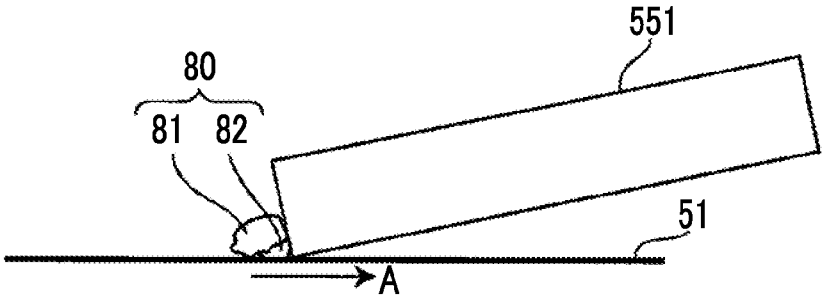
FIGS. 5A to 5C are schematic diagrams illustrating a third example of the method of measuring the amount of the external additive.
Figure 5B:
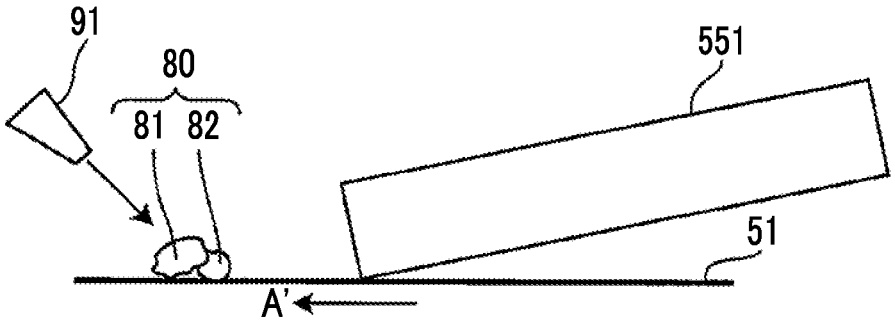
Figure 5C:
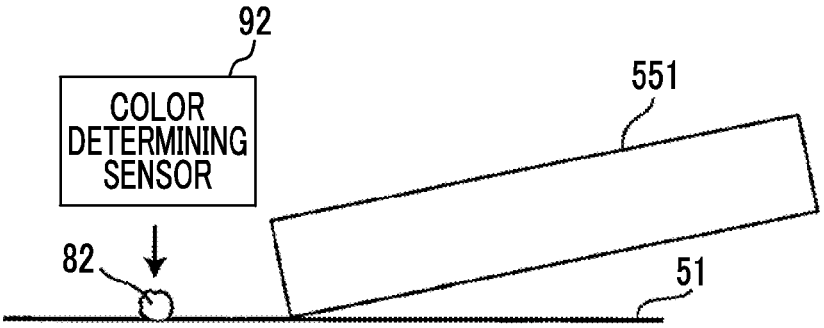

FIGS. 5A to 5C are schematic diagrams illustrating a third example of the method of measuring the amount of the external additive.

With regard to the third example illustrated in FIGS. 5A to 5C, description will be given to a difference from the above-described second example illustrated in FIGS. 4A to 4C.

In a case of the second example illustrated in FIGS. 4A to 4C, as shown in FIG. 4B, in a state in which the photoconductor 51 is reversely rotated in the direction of the arrow A' to detach the toner dam 80 from the cleaning blade 551, and the toner particles 81 are also deposited, the amount of the external additive 82 is measured. In contrast, in the case of the third example illustrated in FIGS. 5A to 5C, as shown in FIG. 5B, the photoconductor 51 is reversely rotated in the direction of the arrow A' to detach the toner dam 80 from the cleaning blade 551, and air is sprayed from the nozzle 91 to the toner dam 80 to blow out the toner particles 81 in the toner dam 80. When air is sprayed from the nozzle 91 at an air pressure of 30 KPa or less, in the toner particles 81 and the external additive 82, only the toner particles 81 are selectively blown out.

In the case of the third example illustrated in FIGS. 5A to 5C, as shown in FIG. 5C, the color of the external additive 82 after blowing-out of the toner particles 81 is determined by the color determining sensor 92. In the case of the third example illustrated in FIGS. 5A to 5C, hindrance of the cleaning blade 551 does not occur and errors due to the toner particles 81 are reduced, and thus the amount of the external additive 82 is more accurately measured.

Figure 6A:
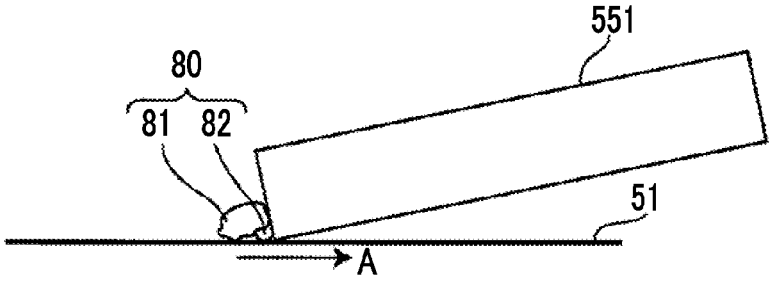
FIGS. 6A to 6C are schematic diagrams illustrating a fourth example of the method of measuring the amount of the external additive.
Figure 6B:
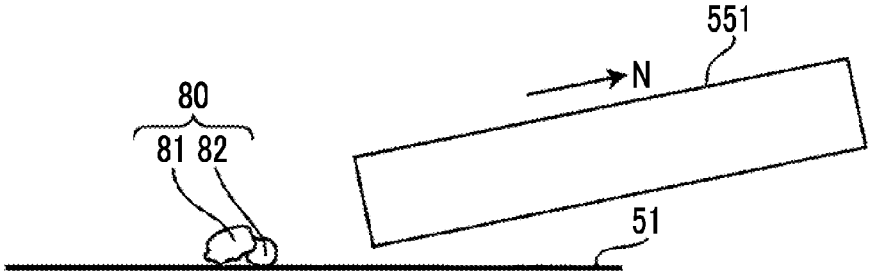
Figure 6C:
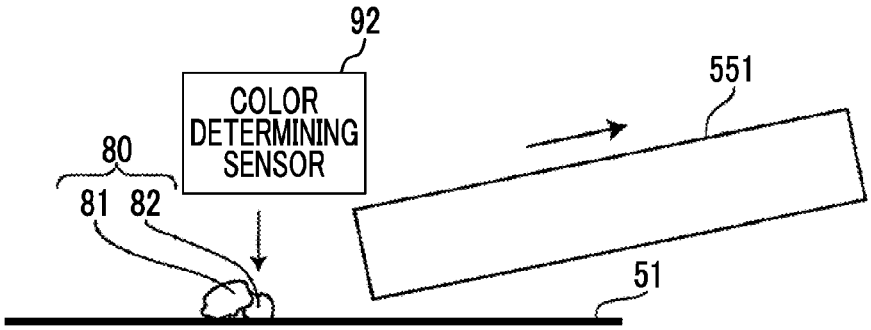

FIGS. 6A to 6C are schematic diagrams illustrating a fourth example of the method of measuring the amount of the external additive.

With regard to the fourth example illustrated in FIGS. 6A to 6C, description will also be given to a difference from the above-described second example illustrated in FIGS. 4A to 4C.

In the case of the second example illustrated in FIGS. 4A to 4C, as shown in FIG. 4B, the photoconductor 51 is reversely rotated in the direction of the arrow A' to detach the toner dam 80 from the cleaning blade 551. In contrast, in the case of the fourth example illustrated in FIGS. 6A to 6C, as shown in FIG. 6B, the cleaning blade 551 is moved in a direction of an arrow N to separate the cleaning blade 551 from the photoconductor 51, and thus the toner dam 80 and the cleaning blade 551 are separated from each other. The other configurations are the same as that of the second example illustrated in FIGS. 4A to 4C, and thus a redundant description will not be made.

However, although not shown, as shown in FIG. 6B, after the cleaning blade 551 is moved in the direction of the arrow N to separate the cleaning blade 551 from the photoconductor 51, air may be sprayed to the toner dam 80 from the nozzle 91 as shown in FIG. 5B to selectively blow out the toner particles 81, and then the external additive 82 that remains on the photoconductor 51 may be measured.

Figure 7:
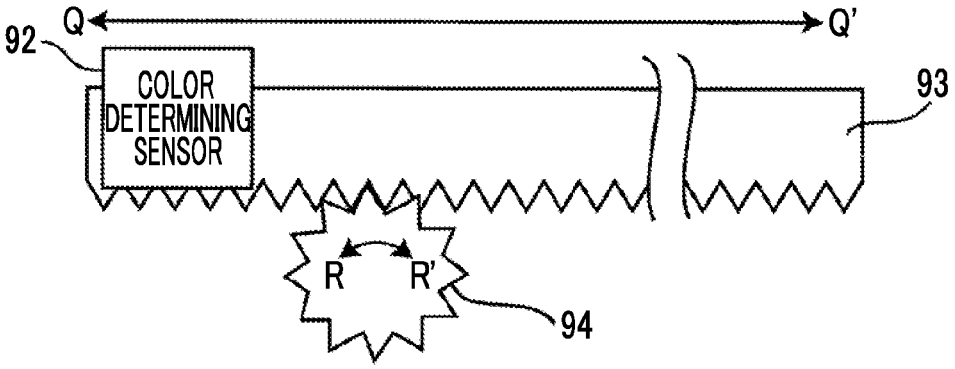
FIG. 7 is a schematic diagram illustrating an example of a method of moving a color determining sensor.

FIG. 7 is a schematic diagram illustrating an example of a method of moving a color determining sensor.

A direction of an arrow Q-Q' shown in FIG. 7 is the rotation axis direction (direction perpendicular to a paper surface of FIG. 2) of the photoconductor 51.

The color determining sensor 92 is fixed to a rack 93, and a pinion gear 94 engages with the rack 93. The pinion gear 94 receives a rotational drive force from a motor (not shown) and reciprocally rotates in a direction of an arrow R-R'. According to this, the rack 93 and the color determining sensor 92 fixed to the rack 93 reciprocally move in the direction of the arrow Q-Q'. The color determining sensor 92 has a measurement visual field of approximately 1 mmΦ.

As shown in FIGS. 3A to 6C, the toner dam 80 has a shape that linearly extends in a rotational axis direction of the photoconductor 51. In addition, the external additive 82, which forms the toner dam 80, also has a shape that linearly extends in the same direction. Therefore, it is also possible to detect a decrease in a partial amount of the external additive 82 by determining an amount of the external additive while reciprocally moving the color determining sensor 92.

However, for example, the method of measuring the amount of the external additive 82 while moving the color determining sensor 92 in the rotational axis direction (the direction of the arrow Q-Q') as shown in FIG. 7 is preferable in consideration of desired high accuracy, but a movement mechanism of the color determining sensor 92 is necessary and time is taken for one measurement. Therefore, only one point in the rotational axis direction may be measured in a state in which the color determining sensor 92 is fixed. Alternatively, an average amount of the external additive 82 in a relatively broad region with respect to the rotational axis direction may be measured by providing a broad measurement visual field with respect to the rotational axis direction without moving the color determining sensor 92.

Here, in the case where it is determined that the amount of the external additive 82, which is measured by the color determining sensor 92, is less than the threshold value, in the above-described examples, the toner band is formed. However, the amount of the external additive 82 in the toner dam 80 may be recovered, and thus there is no limitation to the formation of the toner band. For example, when the amount of the external additive 82 decreases, a toner supply amount from the toner cartridge 23 (23K, 23C, 23M, 23Y) (refer to FIG. 2) to the developing unit 54 is increased with respect to the image forming unit 50 in which the decrease is detected, or with respect to all of the four image forming units 50. In this case, during development of an electrostatic latent image having the same electric potential distribution, a toner image with a heavy density is formed, and thus the amount of the external additive 82 that reaches the cleaning blade 551 also increases proportionally. However, it is necessary to execute the method in a range in which an image density and a color tone are permitted. In addition, according to the method, an effect of recovering the amount of the external additive 82 in the toner dam 80 is gradually exhibited in comparison to the method of forming the toner band. Accordingly, with regard to determination of the measurement result obtained by the color determining sensor 92, it is preferable to initiate control of recovering the amount of the external additive 82 at an early stage in which the amount of the external additive 82 in the toner dam 80 starts to decrease. Alternatively, increasing the toner supply amount and the formation of the above-described toner band may be used in combination.

In this exemplary embodiment, the amount of the external additive 82 in the toner dam 80 is measured, and thus it is correctly determined whether or not a sufficient toner dam is formed.

Here, an example in which the cleaning device of the invention is applied to the image forming apparatus of a type illustrated in FIGS. 1 and 2 has been described. However, the invention is applicable to an arbitrary type apparatus as long as a blade-type cleaning member is brought into contact with the photoconductor to scrape a toner, and the invention is not limited to the image forming apparatus of the type shown in FIGS. 1 and 2.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device that cleans a residual toner from a cleaning target comprising:

a cleaning blade that blocks the residual toner containing toner particles and an external additive on the cleaning target and scrapes the residual toner from the cleaning target;

a measurement unit that measures an amount of the external additive in the residual toner which is blocked by the cleaning blade and remains on the cleaning target; and a control unit that increases an amount of a toner that is supplied to the cleaning target based on a measurement result obtained by the measurement unit.

2. The cleaning device according to claim 1, wherein the measurement unit includes:

an air spraying device that sprays air to the residual toner, which is blocked by the cleaning blade and remains on the cleaning target, to remove the toner particles in the residual toner from the cleaning target; and the measurement unit that measures an amount of the external additive that remains on the cleaning target after the air spraying by the air spraying device.

3. The cleaning device according to claim 1, wherein the measurement unit includes:

a separation unit that separates the residual toner, which is blocked by the cleaning blade and remains on the cleaning target, and the cleaning blade from each other.

4. The cleaning device according to claim 3, wherein the separation unit separates the cleaning blade from the cleaning target.

5. The cleaning device according to claim 3, wherein the separation unit rotates the cleaning target that is rotatable.

6. The cleaning device according to claim 1, wherein the cleaning target has a rotational axis, and the measurement unit measures the amount of the external additive at each position on the cleaning target in a rotation axis direction while moving in the rotational axis direction of the cleaning target.

7. The cleaning device according to claim 1, wherein the control unit forms a toner band on the cleaning target.

8. The cleaning device according to claim 1, wherein the control unit forms a toner image, in which an amount of the toner is increased, on the cleaning target.

9. The cleaning device according to claim 1, wherein a volume average particle size of the toner particles is 2.0 μm to 4.5 μm.

10. The cleaning device according to claim 1, wherein the cleaning target is a photoconductor for electrophotography.

11. An image forming apparatus, comprising:

a photoconductor on which a toner image is formed;

a transfer device that transfers the toner image onto a medium;

a fixing device that fixes the toner image, which is transferred onto the medium; and a cleaning device that removes a residual toner from the photoconductor after the toner image is transferred, wherein the cleaning device includes, a cleaning blade that contacts with the photoconductor, blocks a toner on the photoconductor, and scrapes the toner from the photoconductor;

a measurement unit that measures an amount of an external additive in the toner which is blocked by the cleaning blade and remains on the photoconductor; and a control unit that increases an amount of the toner that is supplied to the photoconductor based on a measurement result obtained by the measurement unit, the toner containing toner particles and the external additive.

* * * * *